US012172260B2

(12) United States Patent
Unnerstall et al.

(10) Patent No.: US 12,172,260 B2
(45) Date of Patent: Dec. 24, 2024

(54) METHOD FOR PARTIALLY GRINDING A SURFACE AND GRINDING DEVICE FOR CARRYING OUT THE METHOD

(71) Applicant: RUD. STARCKE GMBH & CO. KG, Melle (DE)

(72) Inventors: Werner Unnerstall, Melle (DE); Christian Wall, Herford (DE); Christian Burstein, Werther (DE); Stephan Kampmeyer, Melle (DE); Diethard Sinram, Spenge (DE); Peter Alfer, Melle (DE)

(73) Assignee: Rud. Starcke GmbH & Co. KG, Melle (DE)

( * ) Notice: Subject to any disclaimer, the term of this patent is extended or adjusted under 35 U.S.C. 154(b) by 1468 days.

(21) Appl. No.: 16/605,939

(22) PCT Filed: Apr. 16, 2018

(86) PCT No.: PCT/EP2018/059660

§ 371 (c)(1),
(2) Date: Oct. 17, 2019

(87) PCT Pub. No.: WO2018/192871

PCT Pub. Date: Oct. 25, 2018

(65) Prior Publication Data

US 2021/0008682 A1 Jan. 14, 2021

(30) Foreign Application Priority Data

Apr. 18, 2017 (DE) ..... 10 2017 108 191.7

(51) Int. Cl.
*B24B 21/06* (2006.01)

(52) U.S. Cl.
CPC ..... *B24B 21/06* (2013.01)

(58) Field of Classification Search
CPC ..... B24B 49/12; B24B 21/06; B24B 21/08; B24B 21/12; B24B 21/20; B24B 23/06; B24B 27/033

(Continued)

(56) References Cited

U.S. PATENT DOCUMENTS 2,258,733 A 10/1941 Brackett
2,284,556 A * 5/1942 Brackett ..... B24B 21/004 451/168

(Continued)

FOREIGN PATENT DOCUMENTS

CN 101927444 A * 12/2010 ..... B24B 21/00
CN 104249195 A 12/2014

(Continued)

OTHER PUBLICATIONS

Office Action dated Jan. 20, 2022 in related/corresponding CN Application No. 201880025467.8.

(Continued)

*Primary Examiner* — Eric J Rosen
*Assistant Examiner* — Sharonda T Felton
(74) *Attorney, Agent, or Firm* — PATENT PORTFOLIO BUILDERS PLLC

(57) ABSTRACT

A method for removing a flaw on a treated, finally painted surface by grinding involves, after the flaw has been detected, moving a flexible abrasive sheet to the surface and pressing it against the flaw to be machined in such a way that the flaw is detected by a sensor system, which is operatively connected to a robotic arm carrying the grinding plate. The abrasive sheet, which is designed as an abrasive belt, is fed to the grinding plate and the abrasive sheet being pressed against the flaw.

18 Claims, 6 Drawing Sheets

Figure 1:
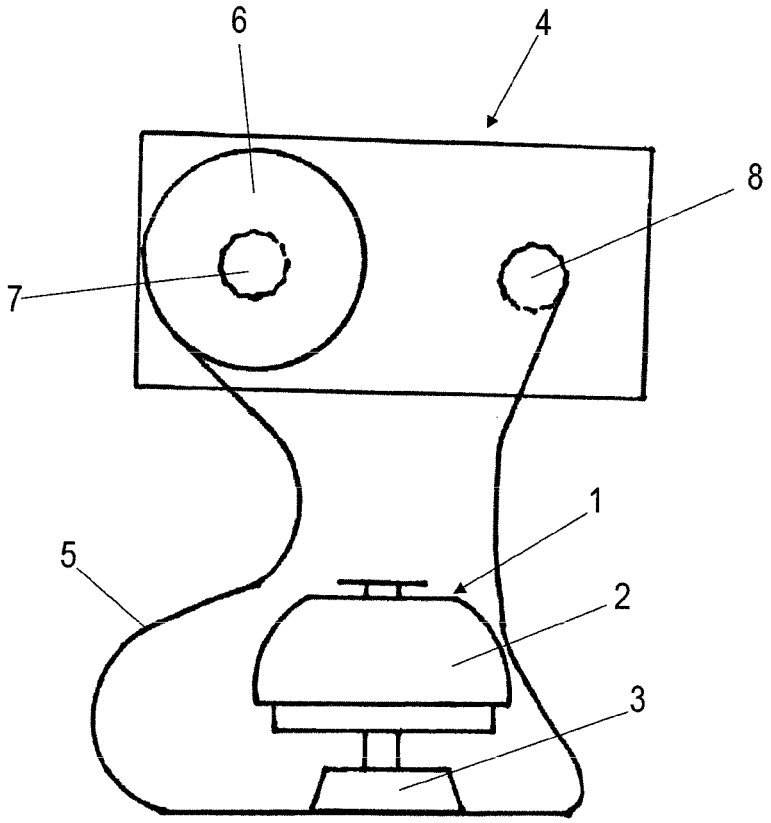

(58) Field of Classification Search
USPC .... 451/6, 303, 304, 296, 297, 311, 492, 493
See application file for complete search history.

(56) References Cited

U.S. PATENT DOCUMENTS

| | | | | | |
|---|---|---|---|---|---|
| 4,676,029 | A * | 6/1987 | Palmer | B24B 7/167 | 451/308 |
| 4,742,650 | A * | 5/1988 | Sauder, Jr. | B24B 21/06 | 451/300 |
| 5,394,654 | A | 3/1995 | Shimbara et al. | | |
| 5,951,377 | A * | 9/1999 | Vaughn | B24B 49/00 | 451/49 |
| 6,217,427 | B1 * | 4/2001 | Case | B24B 37/04 | 451/296 |
| 6,383,063 | B1 * | 5/2002 | Ohashi | B24B 21/06 | 451/303 |
| 7,169,028 | B1 * | 1/2007 | Barton, II | B24B 5/42 | 451/163 |
| 9,724,801 | B2 | 8/2017 | Gu | | |
| 2012/0252320 | A1 * | 10/2012 | Seki | B24B 21/20 | 451/28 |

FOREIGN PATENT DOCUMENTS

| | | | | |
|---|---|---|---|---|
| CN | 104972376 | A * | 10/2015 | |
| CN | 106457505 | A | 2/2017 | |
| DE | 3509004 | A1 | 9/1986 | |
| DE | 3642086 | A1 | 6/1988 | |
| DE | 69925282 | T2 | 2/2006 | |
| DE | 202013101858 | U1 | 5/2013 | |
| DE | 102013104035 | A1 * | 10/2014 | B23Q 17/007 |
| DE | 102014108956 | A1 | 12/2014 | |
| JP | S59205264 | A | 11/1984 | |
| JP | H02131857 | A | 5/1990 | |
| JP | H07256550 | A | 10/1995 | |

OTHER PUBLICATIONS

Office Action mailed Dec. 3, 2020 in related/corresponding CN Application No. 201880025467.8.
Citation of Office Action mailed Jan. 31, 2018 in related/corresponding DE Application No. 10 2017 108 191.7.
International Search Report mailed Jul. 18, 2018 in related/corresponding International Application No. PCT/EP2018/059660.
Written Opinion mailed Jul. 18, 2018 in related/corresponding International Application No. PCT/EP2018/059660.

* cited by examiner

METHOD FOR PARTIALLY GRINDING A SURFACE AND GRINDING DEVICE FOR CARRYING OUT THE METHOD

BACKGROUND AND SUMMARY OF THE INVENTION

Exemplary embodiments of the present invention relate to a method for partially grinding a surface and a grinding device for carrying out the method.

After checking a surface, which is finish-painted in particular, by means of a sensor system, a recognized flaw has heretofore been manually treated, for which purpose a handheld grinding machine is used, having a grinding disk on which an abrasive sheet is held.

The mounting of the abrasive sheet on the grinding disk is typically achieved by a hook-and-loop connection, wherein the pairing grinding disk/abrasive sheet is formed accordingly on the sides thereof facing toward one another.

Another type of fastening of the abrasive sheet on the grinding disk is achieved by a self-adhesive adhesive bond.

A further type of mounting the abrasive sheet on the grinding disk is performed by suction, for which purpose the grinding machine is connected to a suction device.

To remove the flaw, i.e., to match it with the adjacent unflawed regions, an abrasive sheet having a very fine grain is used, wherein the grinding procedure per se is performed in a punctiform manner, but using orbital, rotating, and/or vibrating movements.

A whole array of required work steps results from the manual processing of the flaw, which oppose cost optimization.

Thus, changing the abrasive sheet is relatively time-consuming and thus costly, above all because the abrasive sheet has to be fastened exactly, centrally, and having the correct side on the grinding disk.

An application of the handheld grinding machine having the associated grinding disk and the abrasive sheet fixed thereon not parallel to the surface is particularly subject to error and requires an additional work effort.

When pulling off the abrasive sheet protruding laterally beyond the grinding disk, grinding dust located in the grain can become detached and interfere with the treatment process as a whole, above all because the grinding dust is distributed in a larger region on the surface.

U.S. Pat. No. 5,394,654 discloses a method for removing a flaw of a treated surface, in which the flaw is recognized visually, i.e., by visual inspection, and manually marked. This marking is subsequently acquired by means of cameras as the foundation of a subsequent treatment. However, because of the exclusively visual recognition of the flaw, this method is not suitable for ensuring a uniform, reproducible work sequence.

DE 20 2013 101 858 U1 reflects prior art differing from the method of the type in question. It describes using a facility to grind the surface before surface finishing, for example, by painting. This literature does not give any indication of the treatment of a finish-painted surface, as the method of the type in question provides.

Furthermore, a grinding device is disclosed in U.S. Pat. No. 2,258,733 A, which has an abrasive belt as the abrasive sheet, wherein this grinding device is not suitable, however, for carrying out grinding work of the type in question.

Exemplary embodiments are directed to refining a method of the type in question in such a way that it can be carried out more cost-effectively.

By way of the invention, the grinding of the surface in the region of a flaw is automated, from which an entire array of advantages results over the method according to the prior art.

The duration of the post treatment is shortened, since the abrasive belt is exactly aligned for the optimum use in the connection region to the grinding disk. The exact guiding, which is typically not absolutely maintained during manual treatment, and which requires a longer treatment time to achieve the corresponding result, is now no longer to be taken into consideration with respect to the treatment duration, i.e., the treatment to achieve an optimum grinding result is now possible more reliably, reproducibly, and in a significantly shorter time.

A further advantage of the invention is the possibility of inclining the grinding disk, which has proven to be particularly effective. Both the number of the grinding points and also the grinding result are thus influenced with a reduction of the roughness depth.

Of course, substantial cost advantages result therefrom, which are noteworthy insofar as the treatment of the surface in the meaning of the invention is carried out on mass-produced products, i.e., in a quasi-uninterrupted work sequence.

According to a further concept of the invention, the abrasive belt is supplied from a dispenser to the grinding disk and fixed thereon. This fixation can be performed by a velour hook-and-loop connection, an adhesive bond, or a vacuum connection, wherein then the grinding disk, correspondingly modified with suction openings, is connected to a suction device.

To detach the connection, in particular the hook-and-loop connection and adhesive bond, an ejector is provided in the region of the grinding disk, after the use of which the abrasive belt is moved further by the corresponding distance up into a following unused region of the abrasive belt. The transportation of the abrasive belt preferably takes place cyclically, wherein, depending on the experiential value, the abrasive belt can be used in the unchanged position in relation to the grinding disk for multiple treatment passes.

Due to the cyclic advance of the abrasive belt in the active region of the grinding disk, as needed, a substantial shortening of the treatment time similarly results, in relation to the manual changing of the abrasive sheet.

With the use of a robot according to the invention, a further fitting time reduction results over the prior art due to dispensing with required distances for removing and changing the abrasive sheet.

According to a further aspect of the invention, the abrasive belt dispenser is a cassette having one unwinding shaft and one winding shaft. In this case, this cassette is a component of a grinding device having a robot arm and is to be completely replaced as needed, i.e., after consumption of the abrasive belt, and possibly to be re-equipped with abrasive belt.

Instead of the use of the cassette in the automatic grinding machine, the cassette can also be a component of a handheld grinding device. The grinding dust accumulating during the grinding can be separated in the cassette by way of a corresponding construction of the cassette.

Furthermore, in the grinding device according to the invention, the abrasive belt can partially be held tensioned in the cassette, for which a braking device can be provided in the cassette or directly adjacent outside, but which is functionally connected to the abrasive belt.

To tension the abrasive belt, pneumatically or hydraulically actuated cylinders can be provided, of which one presses the abrasive belt onto a deflection roller before the abrasive belt runs in toward the grinding disk and thus fixes it, and another cylinder engages on the abrasive belt on the outlet side, wherein this cylinder is operationally connected to a force sensor system, for example, a pressure sensor system.

The grinding movement of the surface, as is known from the prior art, is performed in the automatic grinding machine by a corresponding modification of the drive, wherein an orbital or vibrating movement is generated. In the case of rotating grinding, the cassette as a whole is also moved.

To be able to better treat more sensitive surfaces, the longitudinal edges of the abrasive belt are formed differently in the shape thereof, for example, linear, wavy, zigzag, or as a combination thereof.

The length of the used abrasive web is detectable by means of a sensor system. This can be ascertained in a computer-controlled manner via the initial length and the end of the abrasive belt.

Additionally, or alternatively, a sensor, for example, in the form of a laser, which detects a passage provided at the end of the abrasive web, is connected upstream from the grinding disk in the advancing direction of the abrasive belt, wherein this passage is placed in such a way that the abrasive belt length can be maximally utilized.

Problems have heretofore resulted when the abrasive belt, in particular in the case of one the carrier of which consists of paper, tears, which results in damage both on the surface to be ground and also on the grinding device itself.

To detect such a tear, according to a further concept of the invention, a corresponding sensor system is provided, which is preferably arranged before the grinding disk viewed in the passage direction of the abrasive belt. This sensor system is designed, for example, so that it comprises a movement sensor and a follower, which moves synchronously with the abrasive belt and is provided with markings, wherein this sensor system is associated with the non-driven output of the abrasive belt, preferably in the cassette.

In the event of a tear of the abrasive belt, the drawing off thereof by an unwinding shaft is interrupted, so that it is at a standstill, as is the follower, which is arranged in a twist-locked manner in relation to the unwinding shaft and which can be formed as a gear wheel, for example, wherein the teeth form the markings. A different configuration of the follower is also conceivable, if it comprises elements as markings permitting the movement of the follower or its standstill to be detected via the movement sensor.

The method according to the invention and an exemplary embodiment of a grinding device according to the invention will be described hereafter on the basis of the appended drawings.

BRIEF DESCRIPTION OF THE DRAWING FIGURES

Figure 3:
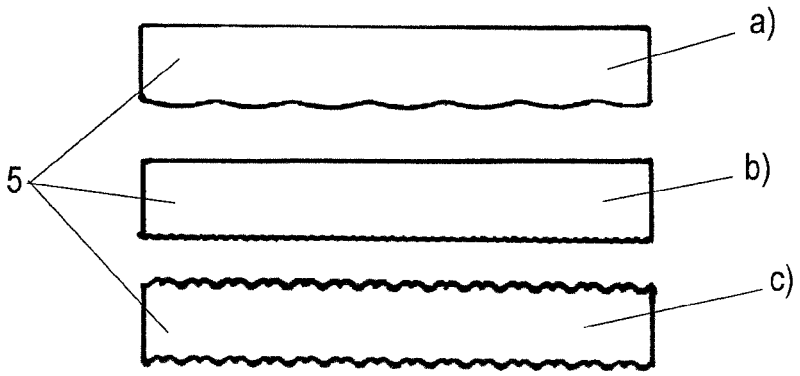
Figure 2:
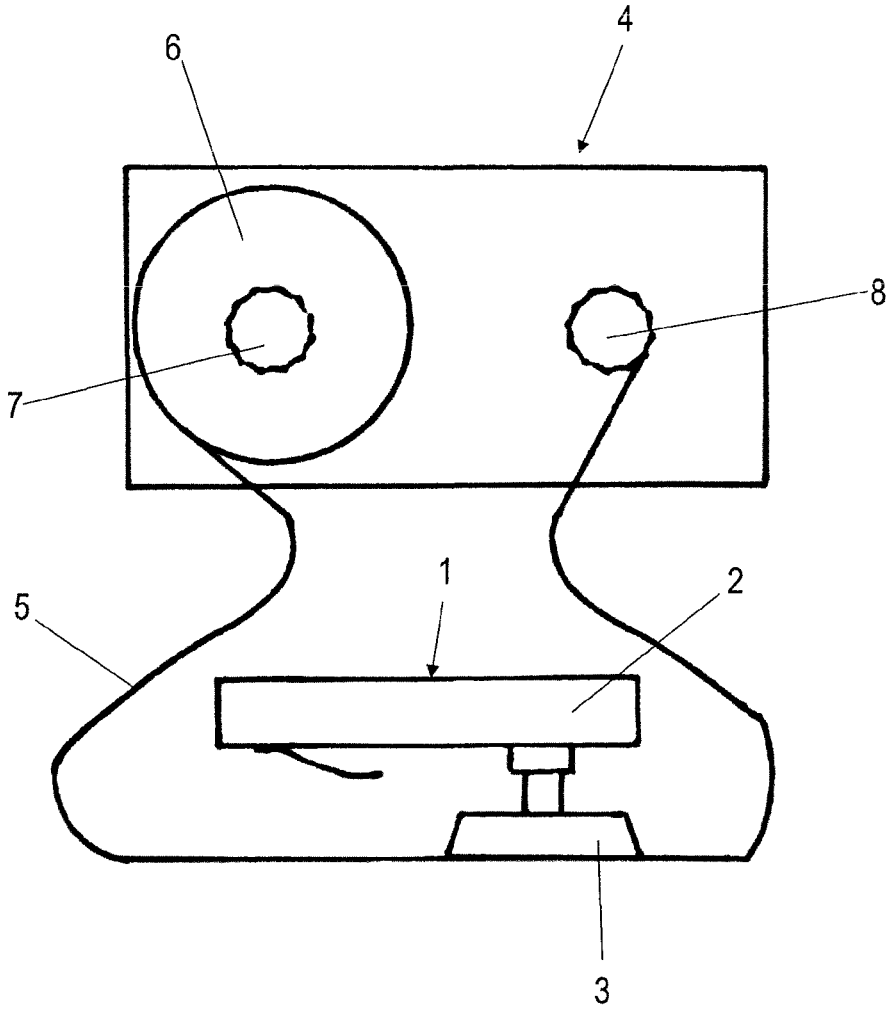
Figure 6:
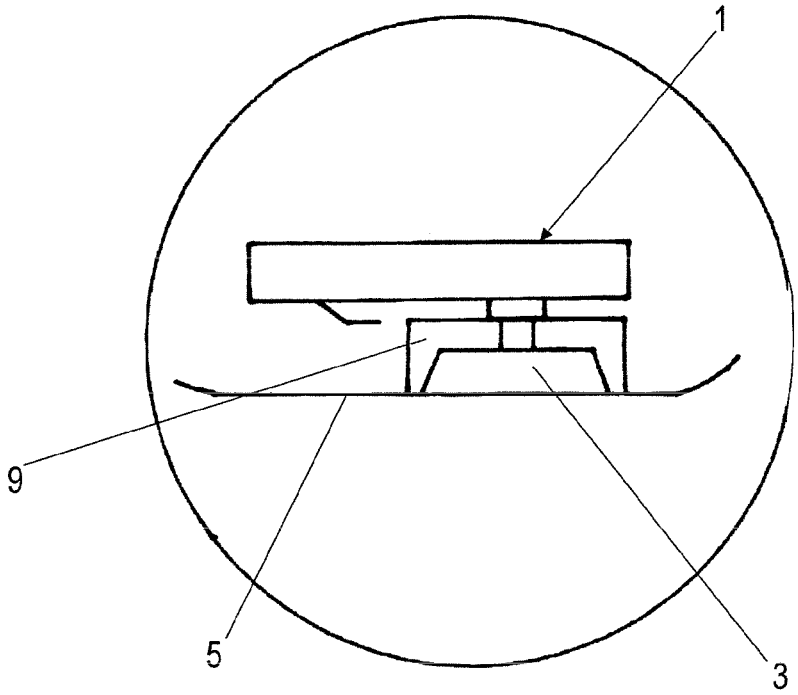
Figure 7:
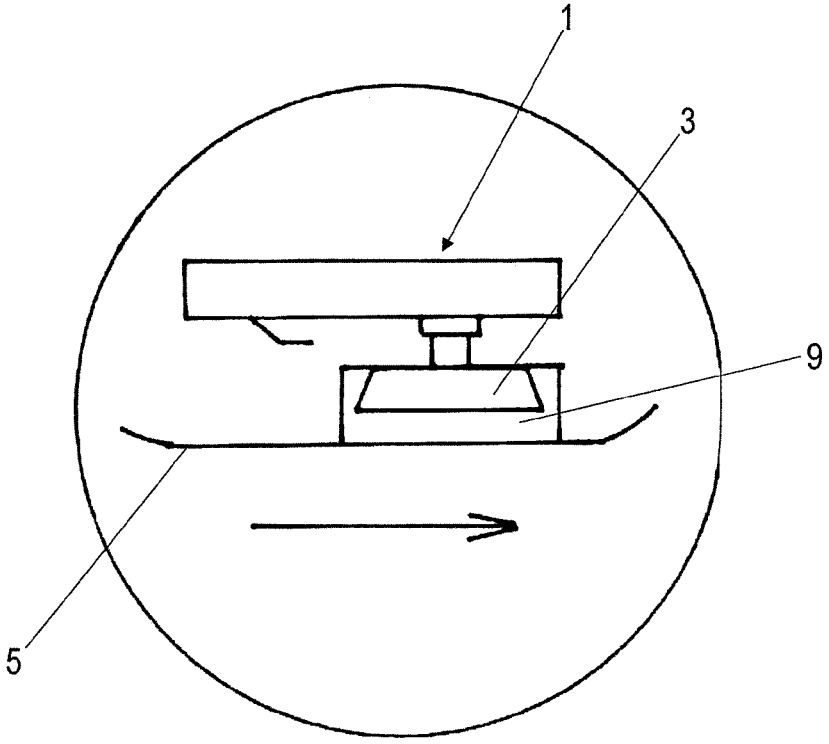
Figure 8:
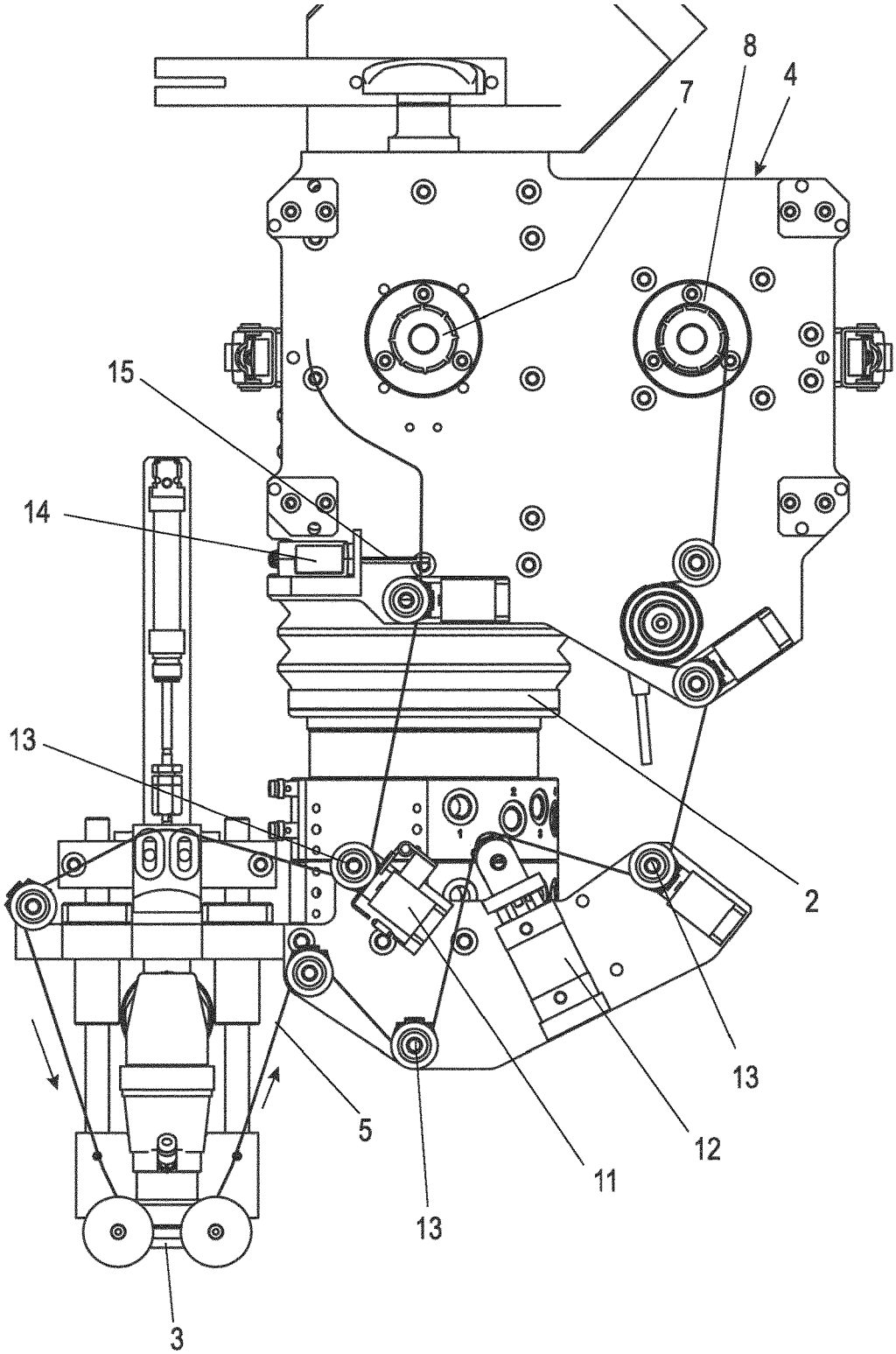
Figure 9:
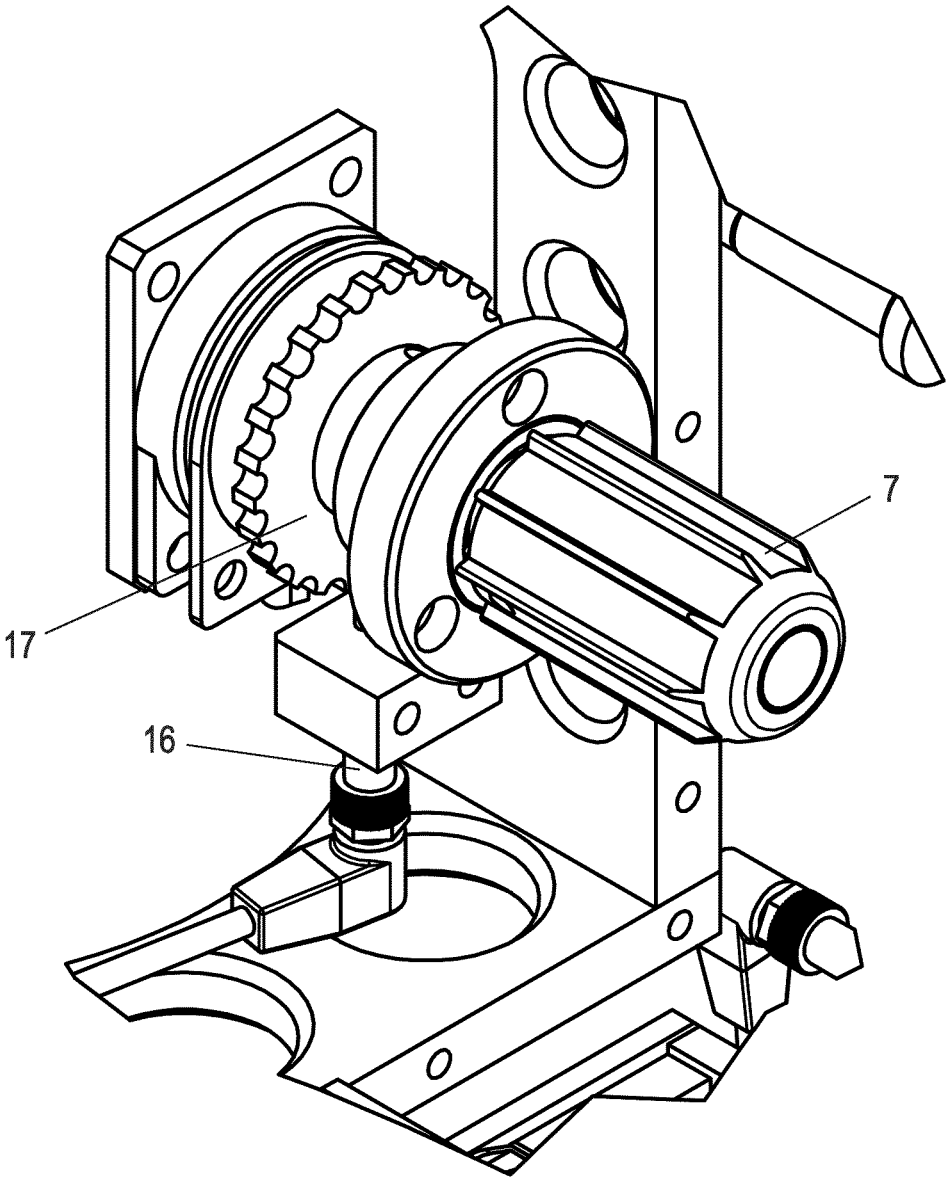

In the figures:

FIGS. 1 and 2 each show a schematic side view of a portion of a grinding device according to the invention FIG. 3 shows a detail of the grinding device in different embodiment variants FIGS. 4-7 each show further embodiment variants of the grinding device in schematic side views FIG. 8 shows a grinding device according to the invention in a front view FIG. 9 shows a part of the grinding device in a perspective view.

DETAILED DESCRIPTION

FIGS. 1 and 2 show a part of a grinding device 1 for removing a flaw, for example, in a finish-treated, in particular finish-painted surface, by grinding, wherein after an optical detection of the flaw by means of an optical sensor system (not shown), a flexible abrasive belt 5 is moved transversely in relation to the surface and pressed against the flaw to be treated.

A robot arm 2 supporting a grinding disk 3, which is moved accordingly by the sensor system to the flaw, is operationally connected to the sensor system.

In this case, the abrasive belt 5 is held on the grinding disk 3, which is movable in relation to the surface, for example, in an orbital, vibrating, or rotating manner, for grinding the flaw.

The abrasive belt 5 is held in a dispenser in the form of a cassette 4 and wound onto a roll 6 on an unwinding shaft 7 and is wound onto a winding shaft 8, preferably cyclically, in accordance with the grinding procedure.

The abrasive belt 5 is mounted on the grinding disk 3 in an integrally-joined or friction-locked manner, for example, by a detachable adhesive bond or by a hook-and-loop connection or suction connection. For the latter, a suction device (not shown) is provided, which is connected to the grinding disk 3.

The abrasive belt 5, which is recognizable as a portion in each of various embodiment variants in FIG. 3, can comprise various contoured edges. Thus, in FIG. 3*a*), one edge of the abrasive belt 5 is formed wavy and the other edge is formed linear. In FIG. 3*b*), both opposing longitudinal edges are formed linear, while FIG. 3*c*) shows a variant in which both longitudinal edges are zigzagged.

Figure 5:
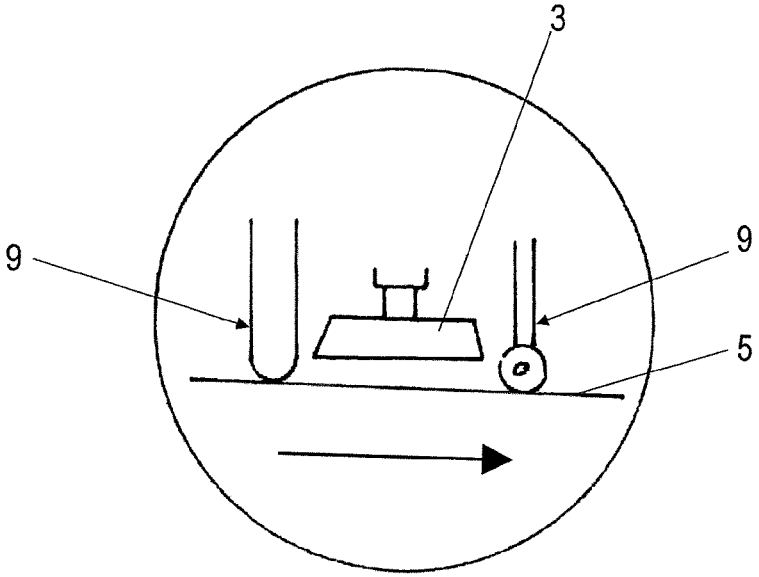

To detach the abrasive belt 5 from the grinding disk 3, ejectors 9 are provided in the region of the grinding disk 3, in accordance with the illustrations in FIGS. 5 to 7.

In this case, ejectors 9 are provided on both sides of the grinding disk 3 in the example shown in FIG. 5, wherein the passage direction of the abrasive belt 5 is identified by an arrow.

In FIGS. 6 and 7, the grinding disk 3 is overlapped by the ejector 9. Functionally, the grinding disk 3 is raised in relation to the ejector 9 in such a manner that the ejector 9 detaches the connection of the grinding disk 3 to the abrasive belt 5 by way of an abutment.

Figure 4:
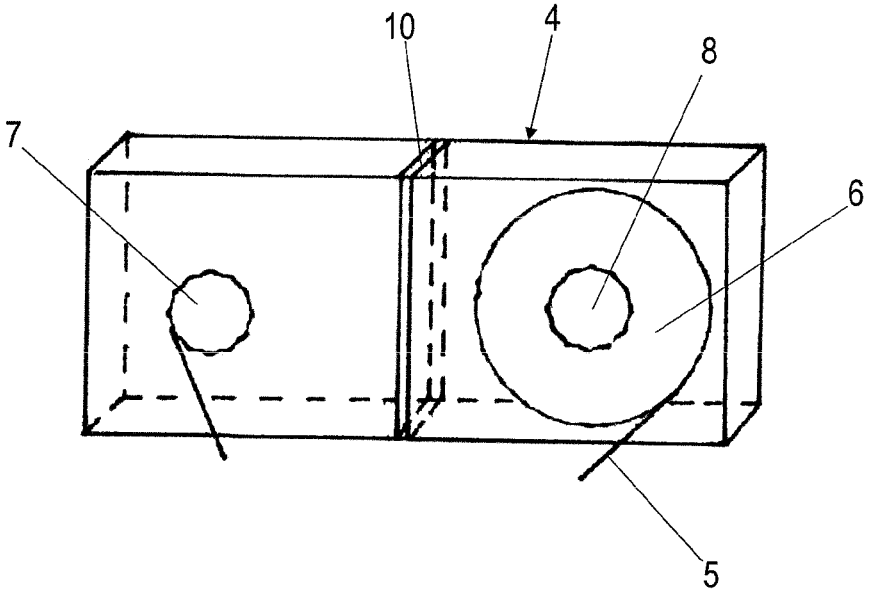

In FIG. 4, the cassette 4 accommodating the abrasive belt 5 is shown as a detail, wherein the unwinding and winding shafts 7, 8 are separated by an intermediate wall 10 in such a way that grinding dust accumulating during the grinding does not reach the region in which the unused abrasive belt 5 is arranged in the form of the roll 6, on the left side in the figure.

FIG. 8 shows a grinding device equipped with the abrasive belt 5, wherein the passage of the abrasive belt 5 is identified by arrow indications.

The winding shaft 8 is driven and draws the abrasive belt 5 off of the unwinding shaft 7, wherein the abrasive belt 5 is guided via a plurality of deflection rollers 13.

To be able to detect the end of the abrasive belt after completed usage, a laser source 14 is provided downstream of the unwinding shaft 7, which detects a passage (not shown) introduced at the end of the abrasive belt 5 during its production with the aid of a laser beam 15, so that the useful length of the abrasive belt 5 can be optimally utilized.

Since the cassette 4 is fixedly connected to the robot arm 2 in the exemplary embodiment, but the grinding disk 3, in contrast, is held using associated assemblies via a movable contact flange on the robot arm 2, the abrasive belt 5 has to be kept under constant tension in the region of the grinding disk 3.

Two tensioning elements are provided for this purpose in the example, specifically in the form of pneumatically or hydraulically actuated cylinders 11, 12, wherein one cylinder 11 presses the abrasive belt 5 against a deflection roller 13 before the entry of the abrasive belt 5 toward the grinding disk 3.

On the outlet side, i.e., downstream of the grinding disk 3, the abrasive belt 5 is tensioned by the cylinder 12, which engages on the abrasive belt 5 between two deflection rollers 13, via which the abrasive belt 5 is guided.

A sensor system is shown as a detail in FIG. 9, using which tearing of the abrasive belt 5 is detected.

This sensor system consists of a movement sensor 16 and a follower 17 corresponding thereto, which is designed as a gear wheel and is held in a rotationally-fixed manner on the unwinding shaft 7, so that it executes a synchronous movement with the freely rotating unwinding shaft 7.

Since the unwinding shaft 7 is quasi-entrained with the abrasive belt upon actuation of the winding shaft 8, which is connected to a motor, the follower 17 is also pivoted accordingly. In the event of a tear of the abrasive belt 5, the unwinding shaft 7 stands still, as does the follower 17, which is detected by the movement sensor 16, so that the drive of the winding shaft 8 is interrupted.

Although the invention has been illustrated and described in detail by way of preferred embodiments, the invention is not limited by the examples disclosed, and other variations can be derived from these by the person skilled in the art without leaving the scope of the invention. It is therefore clear that there is a plurality of possible variations. It is also clear that embodiments stated by way of example are only really examples that are not to be seen as limiting the scope, application possibilities or configuration of the invention in any way. In fact, the preceding description and the description of the figures enable the person skilled in the art to implement the exemplary embodiments in concrete manner, wherein, with the knowledge of the disclosed inventive concept, the person skilled in the art is able to undertake various changes, for example, with regard to the functioning or arrangement of individual elements stated in an exemplary embodiment without leaving the scope of the invention, which is defined by the claims and their legal equivalents, such as further explanations in the description.

LIST OF REFERENCE NUMERALS

1 grinding device
2 robot arm
3 grinding disk
4 cassette
5 abrasive belt
6 roll
7 unwinding shaft
8 winding shaft
9 ejector
10 intermediate wall
11 cylinder
12 cylinder
13 deflection roller
14 laser source
15 laser beam
16 movement sensor
17 follower

The invention claimed is:

1. A method for removing a flaw of a treated finish-painted surface by a grinding device, the method comprising:

detecting the flaw by a sensor system, wherein the sensor system is operationally connected to a robot arm supporting a grinding disk;

moving a flexible abrasive sheet toward the treated finish-painted surface by supplying the flexible abrasive sheet to the grinding disk; and pressing the flexible abrasive sheet against the flaw, wherein the flexible abrasive sheet is an abrasive belt, wherein the grinding disk having the flexible abrasive belt fastened thereon is moved in a rotating, vibrating, or orbital manner, wherein the flexible abrasive belt is mounted in a dispenser, wherein the dispenser comprises a cassette arranged in a region of the robot arm, wherein the cassette comprises a winding shaft and an unwinding shaft, which are respectively configured to wind and unwind the flexible abrasive belt, wherein the grinding device further comprises a sensor system associated with the unwinding shaft and configured to detect a tear in the flexible abrasive belt, and wherein the sensor system associated with the unwinding shaft comprises a movement sensor and a follower, wherein the follower moves synchronously with the flexible abrasive belt or the unwinding shaft, and the follower includes markings detectable by the movement sensor.

2. The method of claim 1, wherein the flexible abrasive sheet is detachably connected in an integrally-joined or friction-locked manner to the grinding disk.

3. The method of claim 1, wherein the flexible abrasive belt is held on the grinding disk by a hook-and-loop connection, adhesive bond, or suction.

4. The method of claim 1, further comprising:

detaching the flexible abrasive belt from the grinding disk after the grinding of the flaw.

5. A method for removing a flaw of a treated finish-painted surface by a grinding device, the method comprising:

detecting the flaw by a sensor system, wherein the sensor system is operationally connected to a robot arm supporting a grinding disk;

moving a flexible abrasive sheet toward the treated finish-painted surface by supplying the flexible abrasive sheet to the grinding disk; and pressing the flexible abrasive sheet against the flaw; and detaching the flexible abrasive sheet from the grinding disk after the grinding of the flaw, wherein the flexible abrasive sheet is an abrasive belt, wherein the flexible abrasive belt is moved further cyclically by a distance of a longitudinal extension of the flaw after being detached from the grinding disk, wherein the flexible abrasive belt is mounted in a dispenser, wherein the dispenser comprises a cassette arranged in a region of the robot arm, wherein the cassette comprises a winding shaft and an unwinding shaft, which are respectively configured to wind and unwind the flexible abrasive belt, wherein the grinding device further comprises a sensor system associated with the unwinding shaft and configured to detect a tear in the flexible abrasive belt, and wherein the sensor system associated with the unwinding shaft comprises a movement sensor and a follower, wherein the follower moves synchronously with the flexible abrasive belt or the unwinding shaft, and the follower includes markings detectable by the movement sensor.

6. A grinding device configured to remove a flaw of a treated finish-painted surface by grinding, the grinding device comprising:

a sensor system configured to detect the flaw;

a robot arm operationally connected in a computer-controlled manner to the sensor system;

a grinding disk fastened on the robot arm;

a flexible abrasive belt that is held on the grinding disk; and an ejector, associated with the grinding disk, configured to detach the flexible abrasive belt held on the grinding disk, wherein the grinding disk is configured to be drivable in an orbital, vibrating, or rotating manner in relation to the treated finish-painted surface, wherein the flexible abrasive belt is mounted in a dispenser, wherein the dispenser comprises a cassette arranged in a region of the robot arm, wherein the cassette comprises a winding shaft and an unwinding shaft, which are respectively configured to wind and unwind the flexible abrasive belt, wherein the grinding device further comprises a sensor system associated with the unwinding shaft and configured to detect a tear in the flexible abrasive belt, and wherein the sensor system associated with the unwinding shaft comprises a movement sensor and a follower, wherein the follower moves synchronously with the flexible abrasive belt or the unwinding shaft, and the follower includes markings detectable by the movement sensor.

7. The grinding device of claim 6, wherein at least one of the longitudinal edges of the flexible abrasive belt is contoured.

8. The grinding device of claim 6, wherein the cassette further comprises two chambers separate from one another, wherein the unwinding shaft is arranged in a first one of the two chambers and the winding shaft is arranged in a second one of the two chambers.

9. The grinding device of claim 6, wherein the winding shaft is configured to be cyclically drivable.

10. The grinding device of claim 6, wherein the winding shaft is configured to be drivable via a motor and the unwinding shaft is nondriven.

11. The grinding device of claim 6, further comprising:

a sensor configured to detect an end of the flexible abrasive belt is associated with the unwinding shaft.

12. The grinding device of claim 11, wherein the sensor configured to detect the end of the flexible abrasive belt comprises a laser emitter, wherein the flexible abrasive belt comprises a passage in an end region, which corresponds to a laser beam of the laser emitter.

13. The grinding device of claim 6, wherein the follower comprises a gear wheel.

14. The grinding device of claim 6, further comprising:

tensioning means configured to tension the flexible abrasive belt.

15. The grinding device of claim 14, wherein the tensioning means consist of hydraulically or pneumatically operated cylinders.

16. The grinding device of claim 14, wherein the tensioning means comprises a first tensioning means on an intake side of the grinding disk and a second tensioning means on an outlet side of the grinding disk.

17. The grinding device of claim 16, wherein the first tensioning means is a hydraulically or pneumatically operated cylinder that is pressable against a deflection roller.

18. The grinding device of claim 17, wherein the second tensioning means is a second hydraulically or pneumatically operated cylinder, which presses against the flexible abrasive sheet between two deflection rollers.

* * * * *